US009827651B2

(12) United States Patent
Shepherd, IV

(10) Patent No.: US 9,827,651 B2
(45) Date of Patent: Nov. 28, 2017

(54) TENSIONING DEVICE

(71) Applicant: Edwin Robert Shepherd, IV, Centennial, CO (US)

(72) Inventor: Edwin Robert Shepherd, IV, Centennial, CO (US)

( * ) Notice: Subject to any disclaimer, the term of this patent is extended or adjusted under 35 U.S.C. 154(b) by 259 days.

(21) Appl. No.: 14/850,956

(22) Filed: Sep. 11, 2015

(65) Prior Publication Data

US 2017/0072541 A1 Mar. 16, 2017

(51) Int. Cl.
*B25B 9/02* (2006.01)
*B25B 31/00* (2006.01)

(52) U.S. Cl.
CPC ..... *B25B 9/02* (2013.01); *B25B 31/00* (2013.01)

(58) Field of Classification Search
CPC ..... B25B 9/00; B25B 9/02; B25B 31/00
See application file for complete search history.

(56) References Cited

U.S. PATENT DOCUMENTS 4,189,822 A * 2/1980 Perline ..... B25B 31/00 29/453
D256,442 S * 8/1980 Martin ..... 254/25
4,883,398 A * 11/1989 Duncan ..... B25B 31/00 411/344
4,997,327 A 3/1991 Cira
5,212,860 A * 5/1993 Lakey ..... B25B 9/00 29/270
6,074,146 A 6/2000 Soemer
6,174,118 B1 1/2001 Rebers et al.
6,203,260 B1 3/2001 Henline et al.
6,324,741 B1 * 12/2001 Brown ..... B21J 15/50 29/268
6,804,869 B1 * 10/2004 Tong ..... B25B 9/02 29/426.1
6,925,909 B2 * 8/2005 Crosby ..... B25C 3/008 81/44
7,409,893 B2 * 8/2008 Maymon ..... B25B 9/00 29/525.11
7,735,806 B2 * 6/2010 Prater ..... B25B 27/00 254/25
8,888,152 B1 * 11/2014 Coakley ..... B25B 9/00 224/267
8,950,992 B1 2/2015 Vayntraub
2003/0025056 A1 * 2/2003 Atchley ..... B25B 9/00 248/304
2006/0185478 A1 * 8/2006 Trozera ..... B25B 9/00 81/13

* cited by examiner

*Primary Examiner* — David B Thomas
(74) *Attorney, Agent, or Firm* — Roger A. Jackson

(57) ABSTRACT

A tensioning device and method of use is disclosed, the tensioning device helps tighten a rotationally free screw including a head and an expanding nut, wherein the screw retains an article to a surface through an aperture in the surface. The tensioning device includes an extension and an arcuate element, wherein a user grasps the extension and positions the arcuate element about the screw and underneath the screw head then manually exerting an axial force to tension the screw causing frictional contact of the expanding nut to an opposing hidden surface thereby allowing the screw to be tightened as against the nut and securing the article to the surface.

14 Claims, 10 Drawing Sheets

TENSIONING DEVICE

RELATED PATENT APPLICATIONS

There are no related patent applications.

FIELD OF THE INVENTION

The present invention generally relates to fasteners that can utilize special tools to speed and ease installation of the fastener. More particularly, the present invention relates to special fasteners that anchor on the blind side of a wall through the use of an expanding nut head, wherein tightening the special fastener is made faster and easier with the use of the present invention tool.

DESCRIPTION OF THE RELATED ART

Fasteners for holding screws that support wall mounted shelving for instance have vastly improved over time allowing the affixment of the shelving to hollow walls-such as drywall where a support stud does not exist, thus the invention of a fastener that has an expanding nut head that can be inserted into a hole in the wall in a collapsed state, wherein the nut head will expand in a radial manner behind the wall in an open state that is urged by typically a spring. The purpose of the expanding nut head is to increase the area of loading on the back side of the wall to allow non-structural (soft/weak) walls to support a greater amount of weight. The problem is that axially the special fastener is loose, i.e. having play along its longitudinal axis which causes a problem when the fastener is tightened as the expanding nut head has no rotational frictional grip on the blind backside of the wall, making conventional fastener tightening difficult.

One solution to this problem is to create axial force by manually pulling outward on the fastener away from the wall to cause the expanded nut head to contact the blind side of the wall for a rotational frictional contact of the expanded nut head as against the blindside surface of the wall while rotationally tightening the fastener, thus causing the expanded nut to remain rotationally static in which the threaded screw will rotate and bring the nut and the head of the screw closer together axially to tighten the fastener. The difficulty in doing this is in applying axial force against the screw portion of the fastener that of necessity must rotate thus requiring a special tool to pull axially upon the rotating screw head. This type of special fastener is typically called a "toggle bolt" that has an especially axially long screw thread to accommodate the expanding nut having to axially poke through the hole in the wall and beyond some distance to allow the expanding nut head room to open. There are a number of versions of the toggle bolt that perform like functions as the following prior art will show.

Looking at the prior art in the toggle bolt type area starting with U.S. Pat. No. 8,950,992 to Vayntraub, disclosed is an anchor for attaching a screw to a wall includes a flat body with a pointed front end, a track aperture formed through a center portion, and a flat back end with a screw guide arm. In Vayntraub, a flat pivot plate has a front end, a back end with an angled portion, a central drive aperture, and a pair of lateral notches formed at two opposing sides thereof. The pivot plate in Vayntraub traverses the track aperture of the body at the notches and in use, the pointed front end of the body is driven through the wall and the screw is inserted adjacent the guide arm to contact the angled portion of the pivot plate to cause same to pivot about the notches until the screw traverses the drive aperture, pulling the pivot plate along the track aperture towards the wall to compress the wall between the screw and the pivot plate. Thus Vayntraub integrates an anti-rotational plate and "C" clamp arrangement for the wall board to overcome the free rotational problem of a conventional toggle bolt nut, however, this product looks to be complicated and expensive to make.

Continuing in the toggle bolt arts in U.S. Pat. No. 6,174,118 to Rebers, et al., disclosed is a threaded fastener retention device that includes a housing having a retainer aperture formed therein and tab retainers adjacent the aperture. A resilient retainer in Rebers is movably mounted in the aperture and the retainer includes a body having tabs for engaging the tab retainers and fastener gripping members for engaging the threads of the fastener and retaining the fastener in the housing. Thus Rebers is essentially a loosely adjustable and replaceable threaded insert for special purpose cable boxes that has a bolt head flange present.

Further, in the toggle bolt arts in U.S. Pat. No. 4,997,327 to Cira, disclosed is essentially a toggle bolt aid in that it centers and aligns the bolt in the oversize hole while a bushing has a flange to prevent the bushing from falling through the hole to the inside of the wall, further there is a flexible restraint loop (128) being integral with the bushing that is placed over the end of the toggle bolt and acts as an anti-rotation arm, so that the toggle nut wings are not dependent upon a frictional contact against the backside of the wall for the nut to tighten the bolt.

Next, in the toggle bolt arts in U.S. Pat. No. 6,203,260 to Henline, et al., disclosed is a toggle bolt assembly for use with an opening in an associated wall, the toggle bolt assembly comprising a bolt of a specified diameter including a threaded diameter, a shank, and a head. The toggle member in Henline has a threaded receiving aperture and a pair of wings pivotally mounted on opposite sides of the aperture, wherein a bolt centering spacer comprises a generally cylindrical body having a first end, a second end, a longitudinal axis, an outside diameter substantially the same as a diameter of a hole in an associated supporting surface, and an opening having a diameter substantially the same as the threaded diameter of the bolt for receiving and centering the bolt. In Henline, a flange positions the bolt centering spacer along a longitudinal axis of a hole in an associated supporting surface and at least one continuous groove circumferentially extends around an outside perimeter of the cylindrical body. Thus in Henline this is a toggle bolt bushing somewhat like Cira for just the bushing part, for the advantage of centering the toggle wings against the back wall surface, plus reducing side radial bolt point loading on the wall drilled hole sidewall.

Continuing in the toggle bolt arts in U.S. Pat. No. 6,074,146 to Soemer, disclosed is a self-aligning connector to engage with a tapered surface of a body to be connected, having a head with a tapered surface capable of engaging the tapered surface of the body to be connected to the receiving body, a shaft portion having threads capable of threadingly engaging threads of the receiving body, a retainer sized and shaped to engage the shaft portion and to seat against a retaining surface of the body to be connected, and a substantially conical spring having an end portion engaging the head and/or shaft portion and another end engaging a surface of the body to be connected opposing the retaining surface and biasing the head and/or shaft portion away from the receiving body. In Soemer, the fastener self-centers the bolt providing a guide and a lock in the same apparatus for a door being typically a right angle door that tend to sag.

What is needed is a special tool that can quickly and easily be inserted over the toggle bolt screw portion thereby facilitating the creation of axial tension on the screw via contacting the screw head and to allow rotation of the screw while simultaneously applying axial force to drawing the expanding nut head to be in frictional contact with the blind side of the drywall board. In essence this special tool would act like a thrust bearing in that an axial load is accommodated at the same time a shaft (screw) rotation is occurring for the period in which the screw is being tightened, and once the screw is close to being tight, the axial tension is not required as the expanding nut head has rotational frictional contact with the blind side of the wall board and thus the special tool would not be needed.

SUMMARY OF INVENTION

Broadly, the present invention is of a tensioning device for securing a rotationally free screw that retains an article to a surface through an aperture in the surface, the screw including external threads with the screw having a head portion, wherein the screw has an outer shank surface and the head has a perpendicularly oriented flange surface, the shank and flange surfaces being about a longwise axis, further an expanding nut is threadably engaged to the screw threads, wherein the nut has an expanded open state and a closed collapsed state. The tensioning device includes an extension having a first end portion and an opposing second end portion with a longitudinal axis spanning therebetween and an arcuate element having a proximal end portion and an opposing distal end portion with an arcuate axis spanning therebetween. The proximal end portion is affixed to the second end portion forming an affixment such that the longitudinal axis and the arcuate axis are positioned at an obtuse angle to one another in a first plane and the longitudinal axis and the arcuate axis are positioned substantially co-incident to one another at the affixment in a second plane.

The arcuate element includes a concave fingered surface that is parallel to the arcuate axis; further the arcuate element includes a platform surface that is positioned perpendicular to the concave fingered surface. Wherein operationally the shank surface slidably pilots on the concave fingered surface and the flange surface has a slidable axial contact on the platform surface such that the screw can freely rotate in the slidable pilot and simultaneously be subject to a selected axial force along the longwise axis via a manual grasping of the extension to facilitate contact frictional pressure of the nut in the open state as against a hidden portion of the surface to allow the screw to tighten against the nut thereby securing the article to the surface.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 8 shows the tensioning device showing the pair of extensions being grasped by the user that has positioned the concave fingered surface of the arcuate element to be adjacent to the shank surface of the screw and the platform surface of the arcuate element to be in the slidable contact with the flange surface of the screw along with the expanding nut that is in threadable engagement with the external threads of the screw, also shown is the power drill/driver that is rotationally engaged to a head portion of the screw, also the expanding nut is shown in an open state having a contact frictional pressure of the nut on the hidden portion of the surface that is a result of the selected manual axial force applied via the user grasping the extensions while simultaneously the screw is tightened via rotation, wherein the threadable engagement of the external threads of the screw to the expanding nut act while tightening to bring together axially the surface and the article to secure the article to the surface;

REFERENCE NUMBERS IN DRAWINGS

Figure 1:
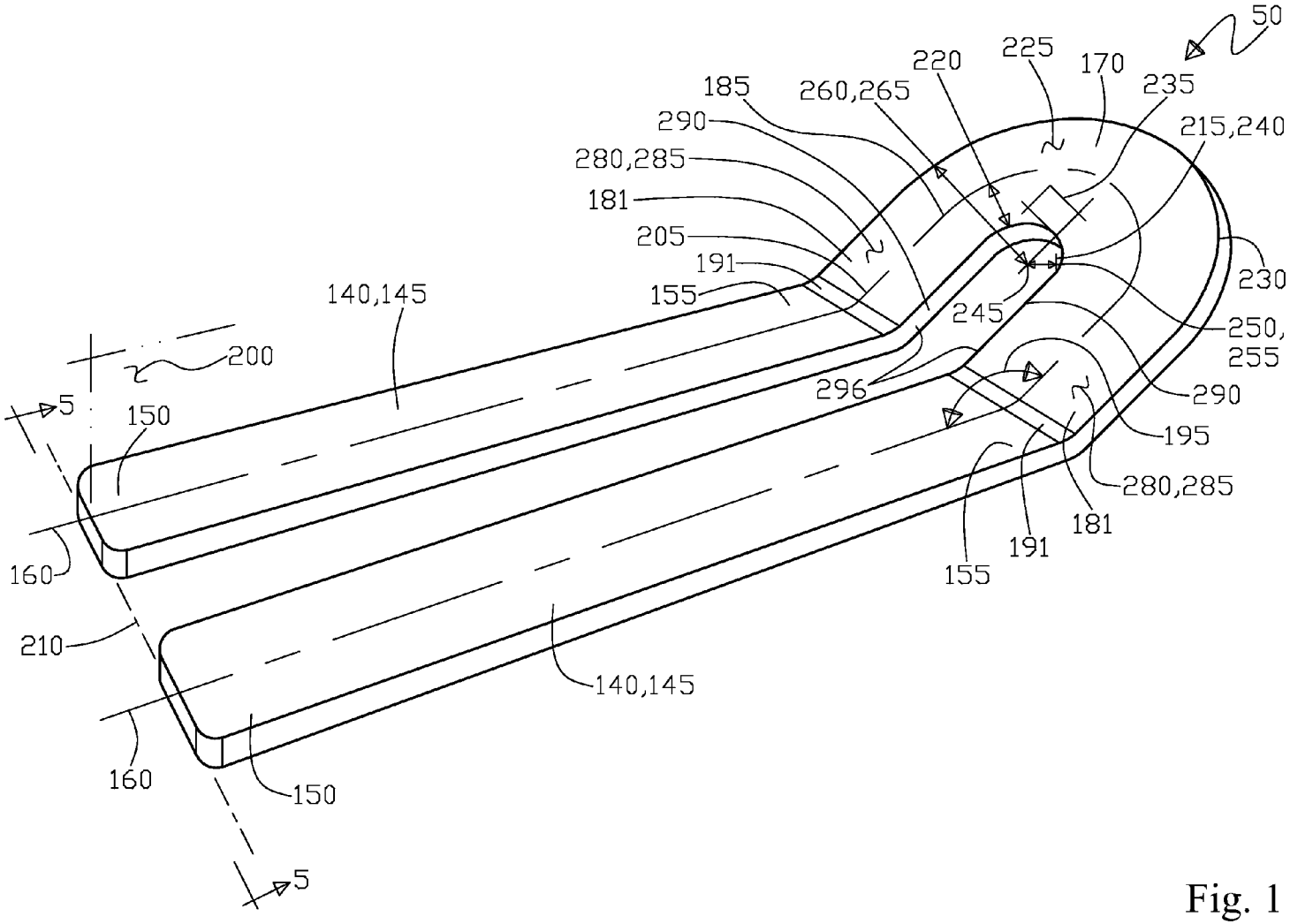
FIG. 1 shows a perspective view of the tensioning device that includes a pair of extensions that each have a first and second end portion, an arcuate element, an obtuse angle as between the extensions and the arcuate element, plus a concave fingered surface of the arcuate element.

50 Tensioning device
51 Alternate embodiment of the tensioning device
55 Rotationally free screw
60 Rotationally free movement of the screw 55
65 External threads of the screw 55
70 Head portion of the screw 55
75 Outer shank surface of the screw 55
80 Flange surface of the screw 55
85 Perpendicular orientation of the flange surface 80 to the outer shank 75
90 Longwise axis of the screw 55
95 Expanding nut
100 Expanded open state of the nut 95
105 Closed collapsed state of the nut 95
110 Threadable engagement of the nut 95 to the external threads 65
115 Contact frictional pressure of the nut 95 in the open state 100 on the hidden portion 130 of the surface 125
120 Article
125 Surface
130 Hidden portion of the surface 125
135 Aperture in the surface 125
140 Extension
145 Pair of extensions 140
150 First end portion of the extension 140
155 Second end portion of the extension 140
160 Longitudinal axis of the extension 140
165 Extension separating from the surface 125
170 Arcuate element
175 Proximal end portion of the arcuate element 170
180 Distal end portion of the arcuate element 170
181 End portions for the arcuate element 170
185 Arcuate axis
190 Affixment between the proximal end portion 175 and the second end portion 155
191 Affixment between the arcuate end portion 181 and the second end portion 155
195 Obtuse angle
200 First plane
205 Co-incident relationship between the longitudinal axis 160 and the arcuate axis 185
210 Second plane
215 Concave fingered surface of the arcuate element 170
220 Parallel relationship of the concave fingered surface 215 and the arcuate axis 185
225 Platform surface of the arcuate element 170
230 Periphery of the platform surface 225
235 Perpendicular relationship between the platform surface 225 and the concave fingered surface 215
240 Semi-circular structure of the concave fingered surface 215
245 Point
250 First radius
255 Length of the first radius 250
260 Second radius
265 Length of the second radius 260
270 Arm
275 Straight surface of the arm 270
280 Extent
285 Pair of extents 280
290 Straight surface of the extent 280
295 Parallel and facing relationship between the extent straight surface 290 and the arm straight surface 275
296 Parallel and facing relationship between the extent straight surfaces 290
300 Inserting the screw 55 and nut 95 in the closed state 105 therethrough the article 120 and the aperture 135
305 Head portion external to the aperture 135
310 Grasping the extension 140
315 Positioning the concave fingered surface 215 to be adjacent to the shank surface 75 and the platform surface 225 to be in slidable contact 325 with the flange surface 80
320 Slidable pilot and functional guide between the shank surface 75 and the concave fingered surface 215
325 Slidable axial contact between the flange surface 80 and the platform surface 225
330 Selected axial force along the longwise axis 90
335 Exerting manual force on the extension 140 away from the surface 125 resulting in the contact frictional pressure 115 of the nut 95 in the open state 100 against the hidden portion 130 of the surface 125
340 Tightening the screw 55 via rotating 60 the screw about the longwise axis 90
345 Removing the arcuate element 170 to be clear from the screw flange surface 80 and the shank surface 75
350 Axial tightening contact as between the flange 80, the article 120, the surface 125, and the nut 95
355 User

DETAILED DESCRIPTION

Figure 2:
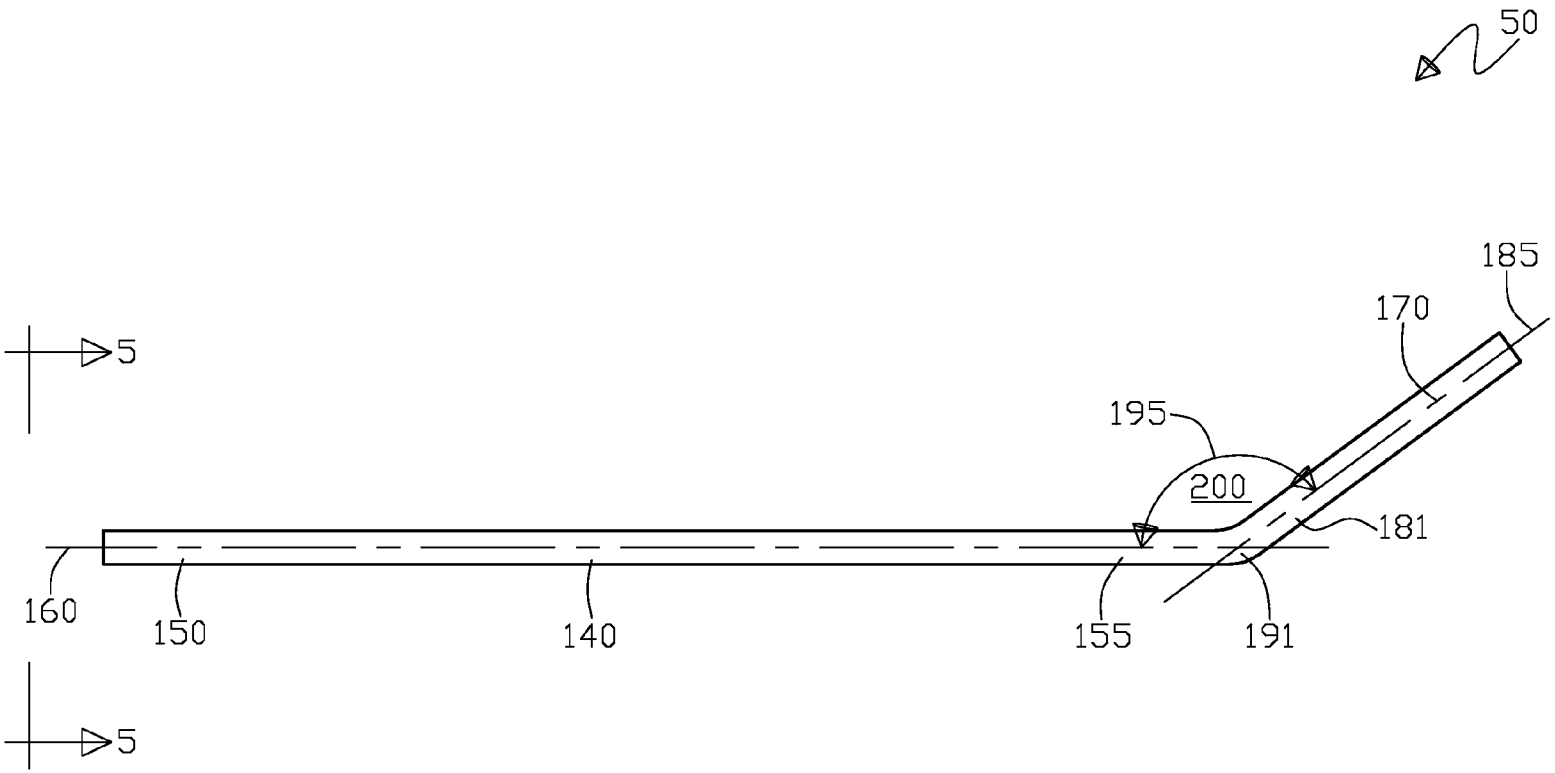
FIG. 2 shows a side elevation view of the tensioning device in FIG. 1 that includes the pair of extensions that each have the first and second end portion, the arcuate element, and the obtuse angle as between the extensions and the arcuate element.

Starting with FIG. 1 shown is a perspective view of the tensioning device 50 that includes a pair of extensions 145 that each have first 150 and second 155 end portions, an arcuate element 170, an obtuse angle 195 as between the extensions 145 and the arcuate element 170, plus a concave fingered surface 215 of the arcuate element 170. Continuing, FIG. 2 shows a side elevation view of the tensioning device 50 in FIG. 1 that includes the pair of extensions 145 that each have the first 150 and second 155 end portions, the arcuate element 170, and the obtuse angle 195 as between the extensions 145 and the arcuate element 170. Further, FIG. 3 shows a perspective view of an alternative embodiment of the tensioning device 51 that includes an extension 140 that has first 150 and second 155 end portions, an arcuate element 170, an obtuse angle 195 as between the extension 140 and the arcuate element 170, plus a concave fingered surface 215 of the arcuate element 170 and the arcuate element 170 proximal 175 and distal 180 end portions.

Figure 3:
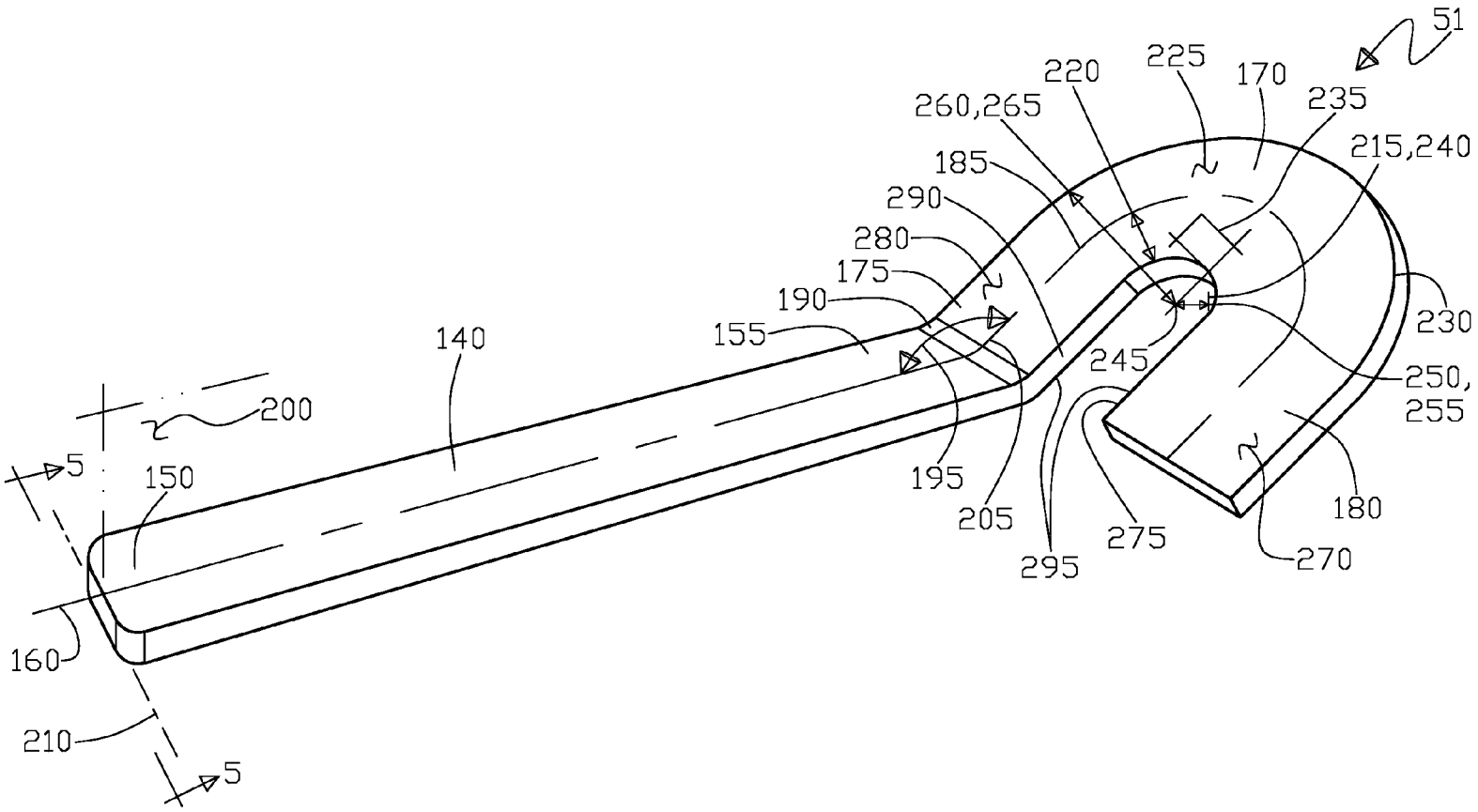
FIG. 3 shows a perspective view of an alternative embodiment of the tensioning device that includes an extension that has a first and second end portion, an arcuate element, an obtuse angle as between the extension and the arcuate element, plus a concave fingered surface of the arcuate element and the arcuate element proximal and distal end portions.
Figure 4:
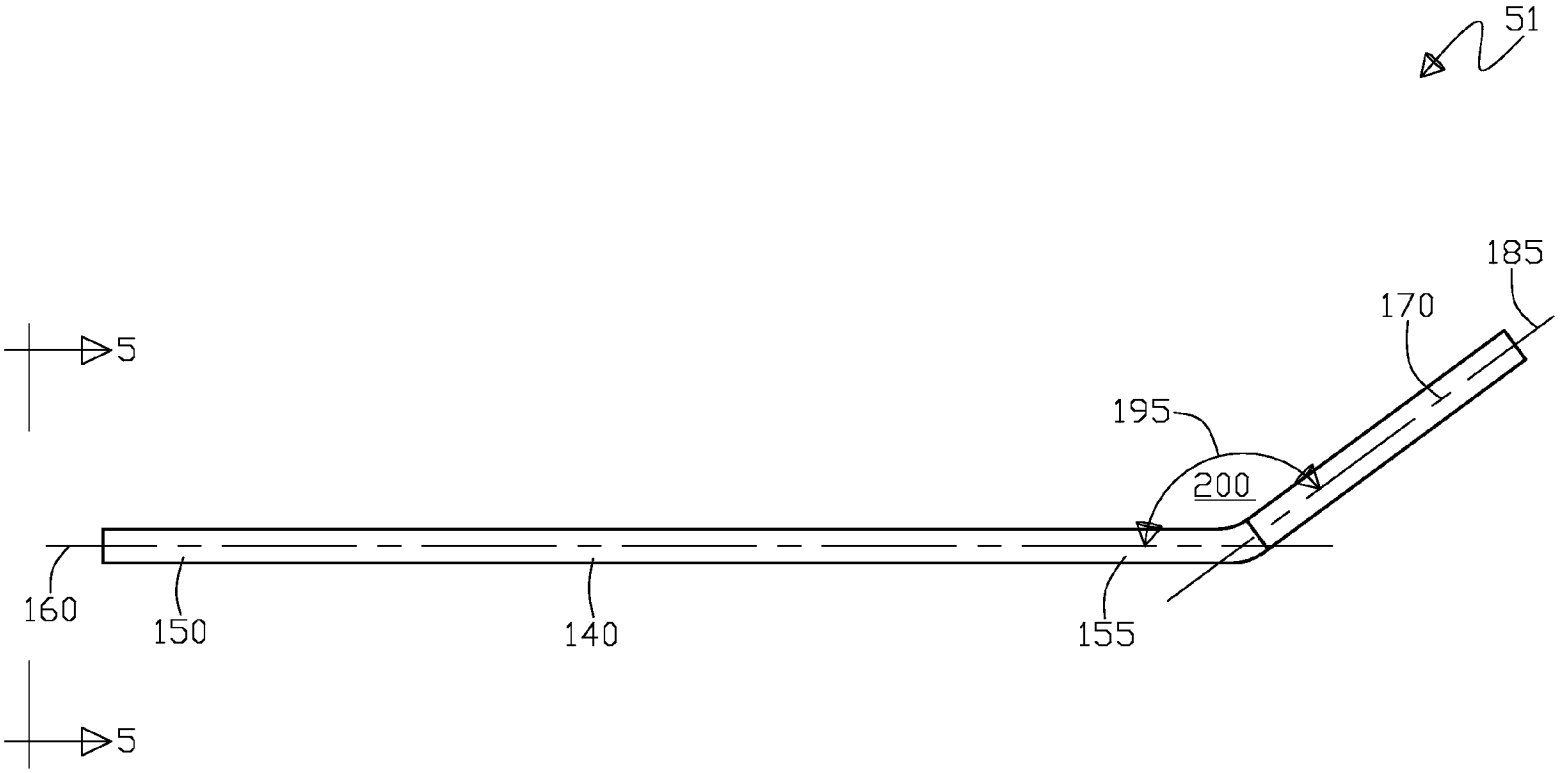
FIG. 4 shows a side elevation view of the tensioning device in FIG. 3 that includes the extension that has the first and second end portions, the arcuate element, and the obtuse angle as between the extension and the arcuate element.
Figure 5:
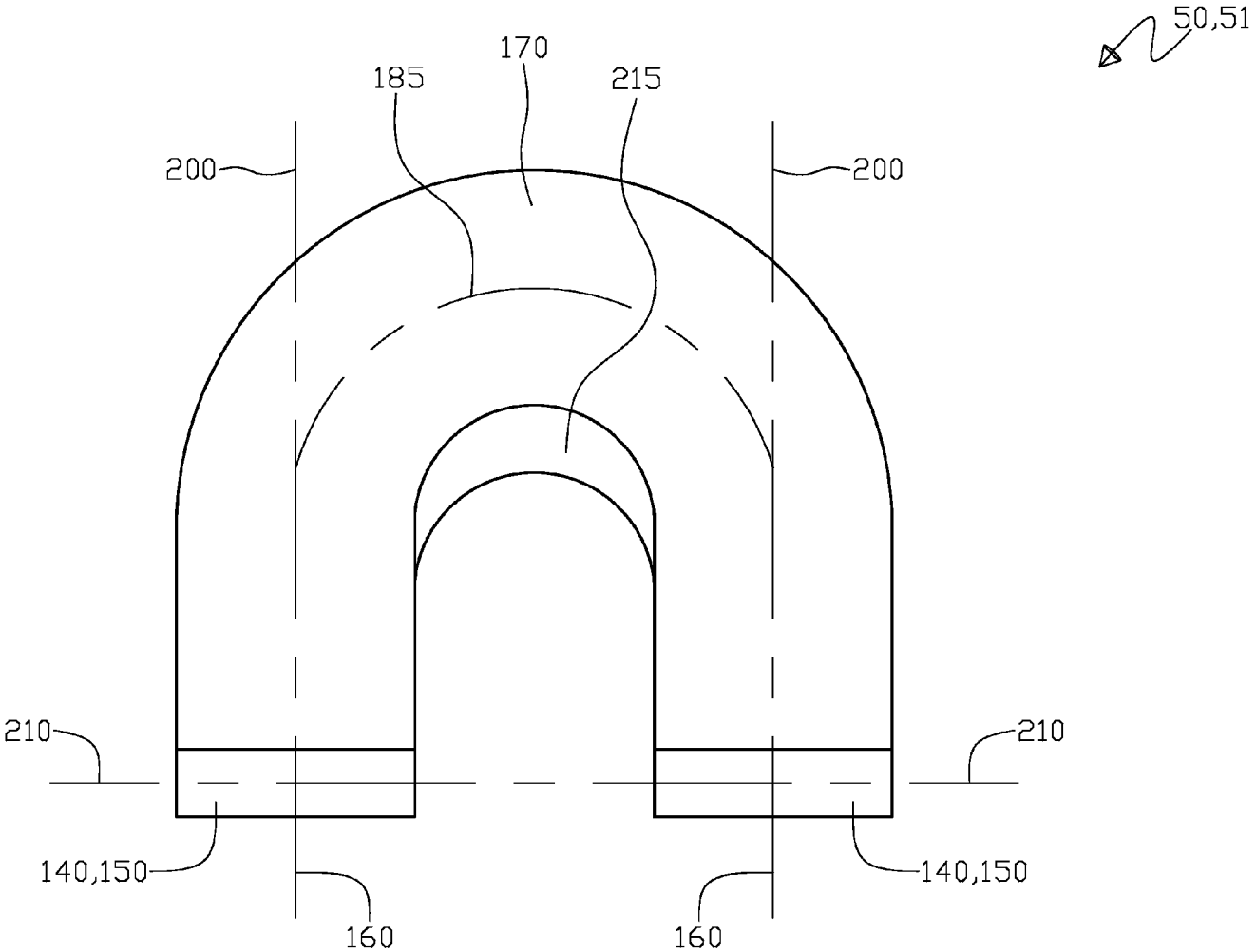
FIG. 5 shows an end elevation view 5-5 from FIGS. 1-4 to more clearly show the arcuate element, the concave fingered surface of the arcuate element, and first and second planes of reference.

Moving onward, FIG. 4 shows a side elevation view of the tensioning device 51 in FIG. 3 that includes the extension 140 that has the first 150 and second 155 end portions, the arcuate element 170, and the obtuse angle 195 as between the extension 140 and the arcuate element 170. Next, FIG. 5 shows an end elevation view 5-5 from FIGS. 1-4 to more clearly show the arcuate element 170, the concave fingered surface 215 of the arcuate element 170, and first 200 and second 210 planes of reference. Further, FIG. 6 is a use perspective view of the tensioning device 50 showing the pair of extensions 145 being grasped 310 by the user 355 that has positioned the concave fingered surface 215 of the arcuate element 170 to be adjacent to a shank surface 75 of the screw 55 and a platform surface 225 of the arcuate element 170 to be in a slidable contact 325 with a flange surface 80 of the screw 55 along with an expanding nut 95 that is in threadable engagement 110 with external threads 65 of the screw 55, also shown is a power drill/driver that is rotationally engaged to a head portion 70 of the screw 55.

Figure 6:
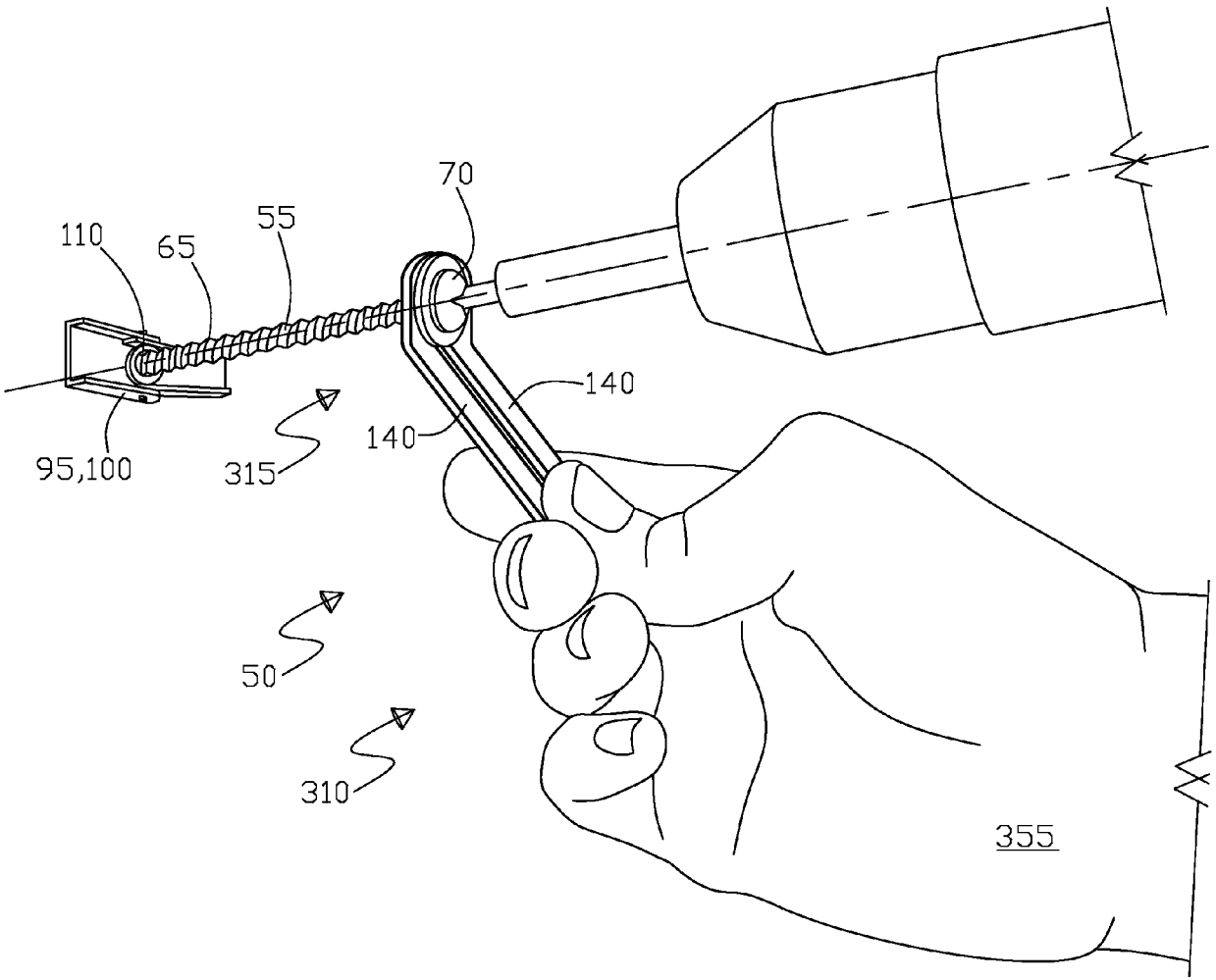
FIG. 6 is a use perspective view of the tensioning device showing the pair of extensions being grasped by the user that has positioned the concave fingered surface of the arcuate element to be adjacent to a shank surface of the screw and a platform surface of the arcuate element to be in a slidable contact with a flange surface of the screw along with an expanding nut that is in threadable engagement with external threads of the screw, also shown is a power drill/driver that is rotationally engaged to a head portion of the screw.
Figure 7:
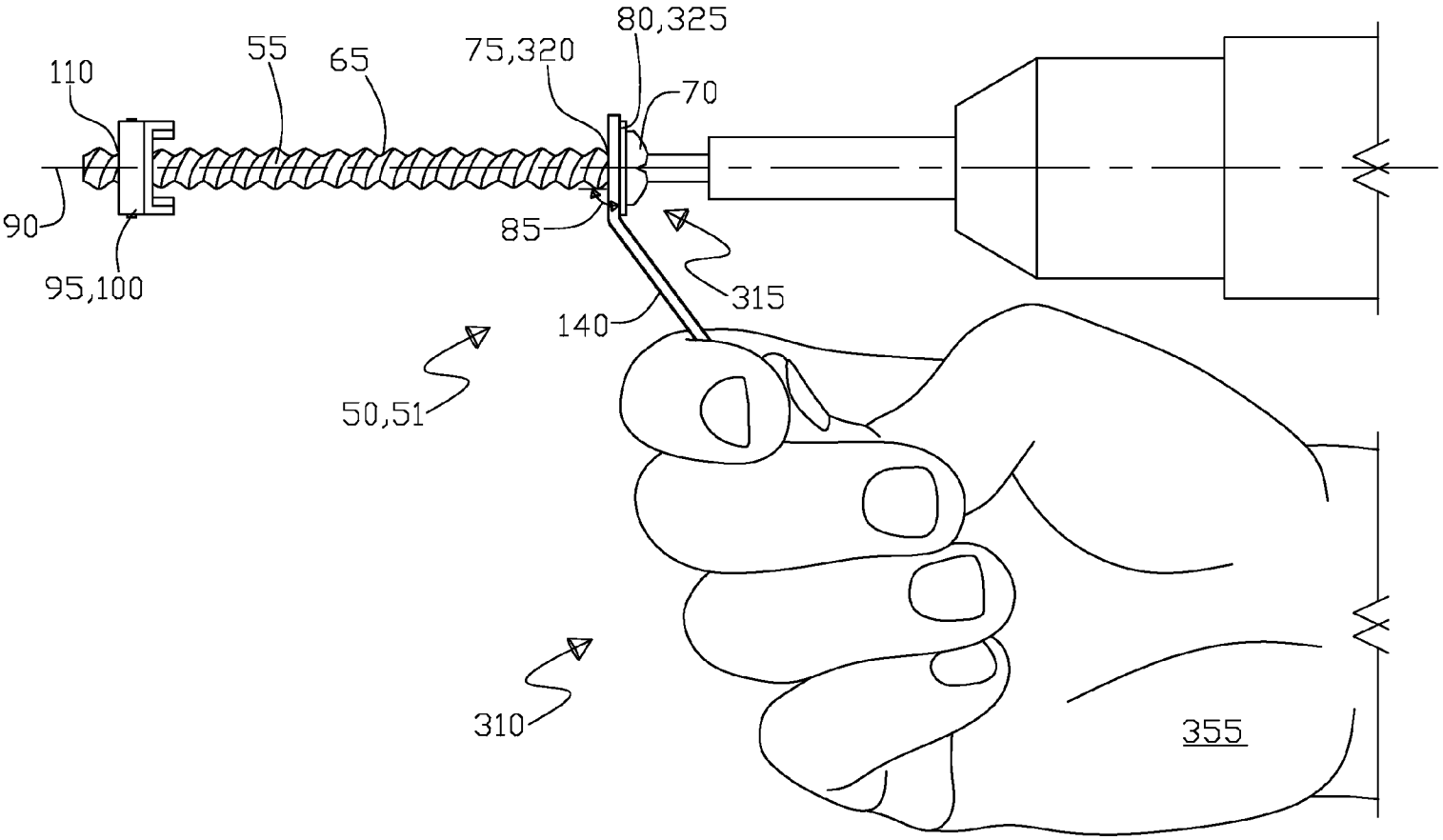
FIG. 7 is a use side elevation view of FIG. 6 that includes the tensioning device showing the pair of extensions being grasped by the user that has positioned the concave fingered surface of the arcuate element to be adjacent to the shank surface of the screw and the platform surface of the arcuate element to be in the slidable contact with the flange surface of the screw along with the expanding nut that is in threadable engagement with the external threads of the screw, also shown is the power drill/driver that is rotationally engaged to a head portion of the screw.

Continuing, FIG. 7 is a use side elevation view of FIG. 6 that includes the tensioning device 50, 51 showing the pair of extensions 140, 141 being grasped 310 by the user 355 that has positioned the concave fingered surface 215 of the arcuate element 170 to be adjacent to the shank surface 75 of the screw 55 and the platform surface 225 of the arcuate element 170 to be in the slidable contact 325 with the flange surface 80 of the screw 55 along with the expanding nut 95 that is in threadable engagement 110 with the external threads 65 of the screw 55, also shown is the power drill/driver that is rotationally engaged to the head portion 70 of the screw 55.

Figure 8:
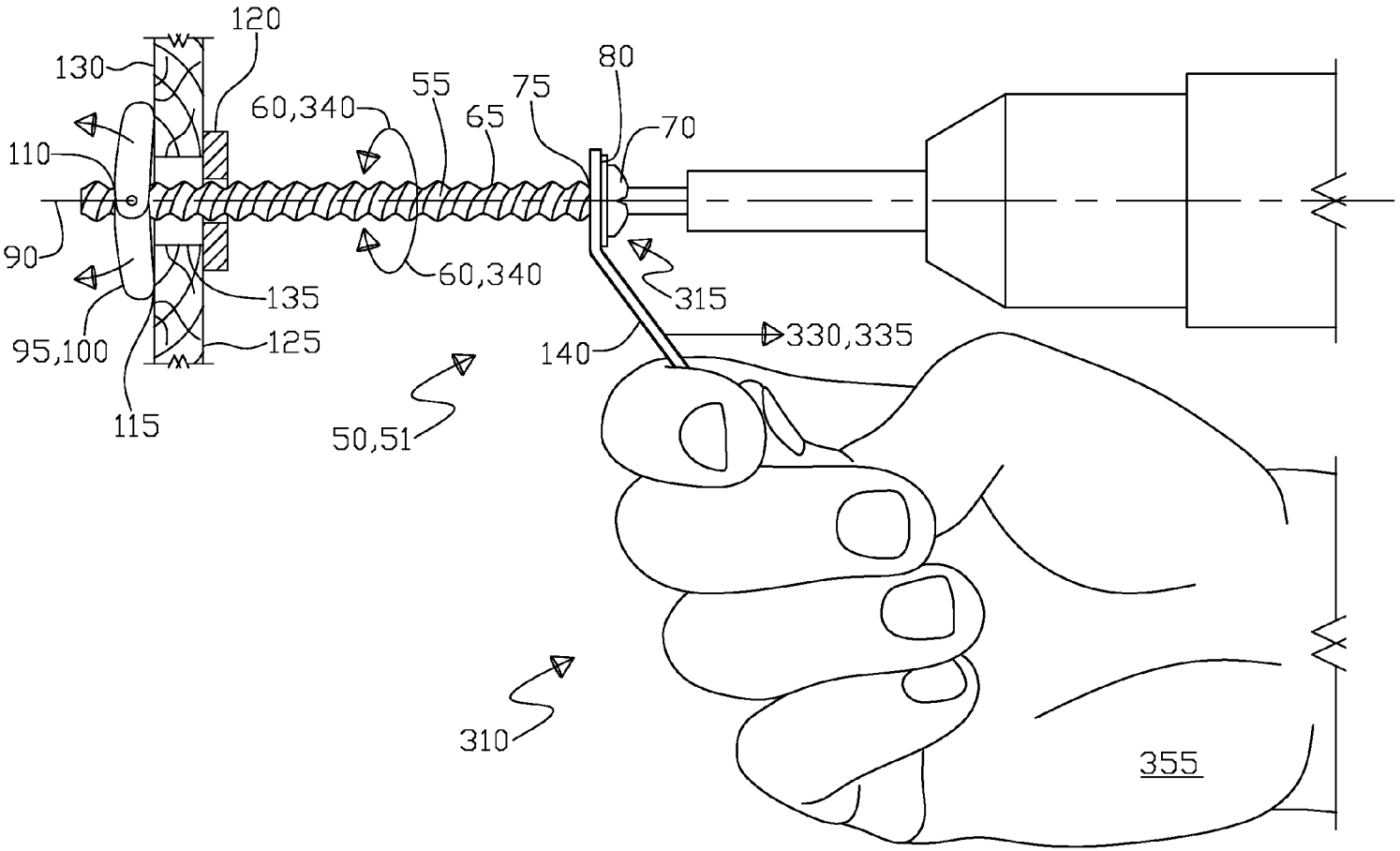
FIG. 8 is a use side elevation view of FIG. 7 that additionally includes an article that is to be mounted on a surface, the surface, a hidden portion of the surface, and an aperture in the surface, further

Yet further, FIG. 8 is a use side elevation view of FIG. 7 that additionally includes an article 120 that is to be mounted on a surface 125, the surface 125, a hidden portion 130 of the surface 125, and an aperture 135 in the surface 125, further FIG. 8 shows the tensioning device 50, 51 showing the pair of extensions 140, 145 being grasped 310 by the user 355 that has positioned the concave fingered surface 215 of the arcuate element 170 to be adjacent to the shank surface 75 of the screw 55 and the platform surface 225 of the arcuate element 170 to be in the slidable contact 325 with the flange surface 80 of the screw 55 along with the expanding nut 95 that is in threadable engagement 110 with the external threads 65 of the screw 55. Also shown in FIG. 8 is the power drill/driver that is rotationally engaged to a head portion 70 of the screw 55, also the expanding nut 95 is shown in an open state 100 having a contact frictional pressure 115 of the nut 95 on the hidden portion 130 of the surface 125 that is a result of the selected manual axial force 330, 335 applied via the user 355 grasping 310 the extensions 140, 145 while simultaneously the screw 55 is tightened 340 via rotation 60, wherein the threadable engagement 110 of the external threads 65 of the screw 55 to the expanding nut 95 act while tightening 340 to bring together axially the surface 125 and the article 120 to secure the article 120 to the surface 125.

Figure 9:
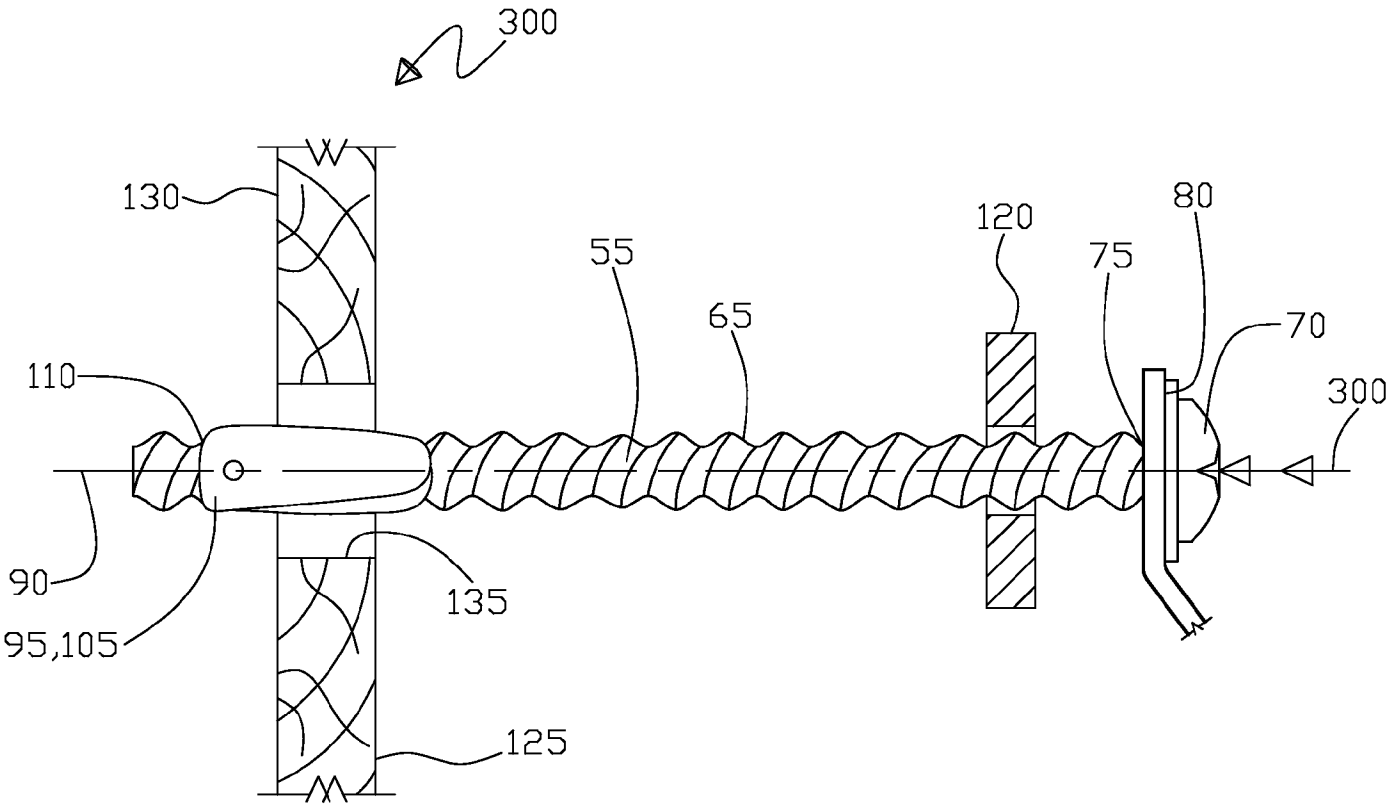
FIG. 9 is a use side elevation view of preparing for FIG. 8 that includes the article that is to be mounted on the surface, the surface, the hidden portion of the surface, and the aperture in the surface, wherein the expanding nut is shown in a closed state being inserted therethrough the aperture in the surface, thus once the expanding nut is clear of the aperture in the surface on the hidden portion of the surface the expanding nut will assume the open state as shown in FIG. 8.

Next, FIG. 9 is a use side elevation view of preparing for FIG. 8 that includes the article 120 that is to be mounted on the surface 125, the surface 125, the hidden portion 130 of the surface 125, and the aperture 135 in the surface 125 wherein the expanding nut 95 is shown in a closed state 105 being inserted therethrough the aperture 135 in the surface 125, thus once the expanding nut 95 is clear of the aperture 135 in the surface 125 on the hidden portion 130 of the surface 125 the expanding nut 95 will assume the open state 100 as shown in FIG. 8.

Figure 10:
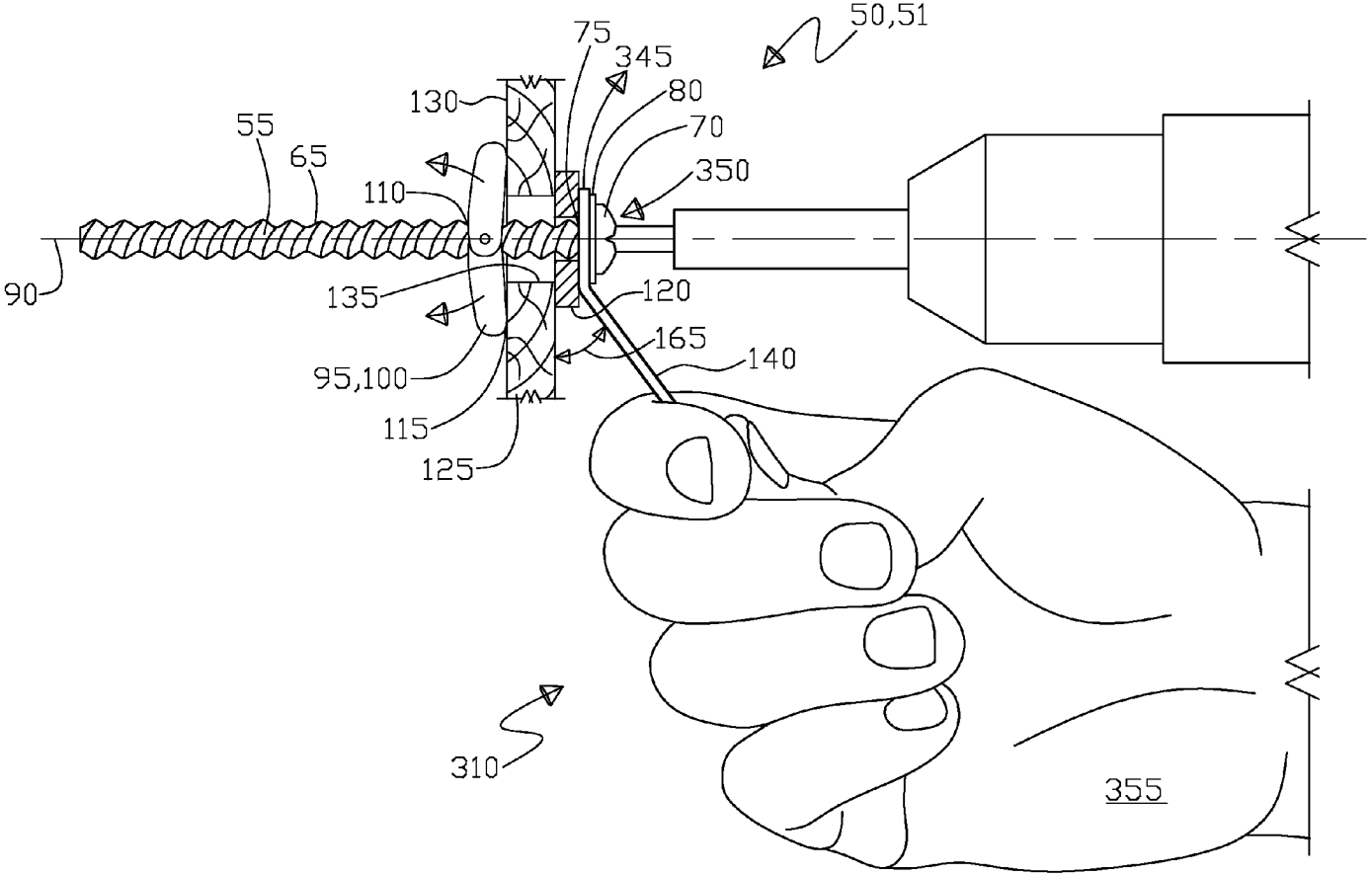
FIG. 10 is a use side elevation view of FIG. 8 wherein the screw tightening operation is nearly complete with the article having been drawn toward the surface axially, wherein the tensioning device can be removed just prior to the article coming into tightening contact with the surface, with a final tightening to having the article secured to the surface, noting that the expanding nut contact frictional pressure to the hidden portion of the surface will be adequate just prior to tightening the screw to not require the manual axial force, alternatively, the tensioning device could be left on the screw being sandwiched as between the head portion of the screw and the article with the screw tightened.

Continuing, FIG. 10 is a use side elevation view of FIG. 8 wherein the screw 55 tightening 340 operation is nearly complete with the article 120 having been drawn toward the surface 125 axially, wherein the tensioning device 50, 51 can be removed just prior to the article 120 coming into tightening 340 contact with the surface 125, with a final tightening 340 to having the article 120 secured to the surface 125. Noting that in FIG. 10 the expanding nut 95 contact frictional pressure 115 to the hidden portion 130 of the surface 125 will be adequate just prior to tightening 340 the screw 55 to not require the manual axial force 330, 335 alternatively, the tensioning device 50, 51 could be left on the screw 55 being sandwiched as between the head portion 70 of the screw 55 and the article 120 with the screw 55 tightened 340 as shown.

Broadly, in referring to FIGS. 3, 4, and 5 the present invention is of the alternate embodiment of the tensioning device 51 for securing the rotationally free screw 55 that retains the article 120 to the surface 125 through the aperture 135 in the surface 125, see FIGS. 8, 9, and 10. The screw 55 including external threads 65 with the screw 55 having the head portion 70, wherein the screw 55 has an outer shank surface 75 and the head 70 has a perpendicularly oriented 85 flange surface 80, with the shank 75 and flange 80 surfaces being about a longwise axis 90, see FIGS. 6, 7, 8, 9, and 10. Further, the expanding nut 95 is threadably engaged 110 to the screw threads 65, wherein the nut 95 has the expanded open state 100 and the closed collapsed state 105, see in particular FIGS. 9 and 10.

The tensioning device 51 includes the extension 140 having the first end portion 150 and the opposing second end portion 155 with a longitudinal axis 160 spanning therebetween and the arcuate element 170 having the proximal end portion 175 and the opposing distal end portion 180 with an arcuate axis 185 spanning therebetween, see FIGS. 3, 4, and 5. The proximal end portion 175 is affixed 190 to the second end portion 155 forming an affixment 190 such that the longitudinal axis 160 and the arcuate axis 185 are positioned at the obtuse angle 195 to one another in the first plane 200 and the longitudinal axis 160 and the arcuate axis 185 are positioned substantially co-incident 205 to one another at the affixment 190 in the second plane 210, again see FIGS. 3, 4, and 5.

The arcuate element 170 includes the concave fingered surface 215 that is parallel 220 to the arcuate axis 185, further the arcuate element 170 includes the platform surface 225 that is positioned perpendicular 235 to the concave fingered surface 215, as best shown in FIGS. 3 and 5. Wherein operationally, the shank surface 75 slidably pilots 320 on the concave fingered surface 215 and the flange surface 80 has a slidable axial contact 325 on the platform surface 225 such that the screw 55 can freely rotate 60 in the slidable pilot 320 and simultaneously be subject to the selected axial force 330, 335 along the longwise axis 90 via the manual grasping 310 of the extension 140 to facilitate contact frictional pressure 115 of the nut 95 in the open state 100 as against the hidden portion 130 of the surface 125, to allow the screw 55 to tighten 340 against the nut 95 thereby securing the article 120 to the surface 125, see FIGS. 6, 7, 8, 9, and 10.

Optionally on the tensioning device 51, the concave fingered surface 215 is at least preferably structurally semi-circular 240 in circumferential length within the first plane 200, see FIGS. 3 and 5, to better encompass the shank surface 75 to functionally guide the shank surface 75 within the concave fingered surface 215, as best shown in FIGS. 6, 7, 8, 9, and 10. Further alternatively, on the tensioning device 51, the concave fingered surface 215 continues to an arm 270 that has a straight surface 275 within the first plane 200, see FIGS. 3, 4, and 5, to further encompass the shank surface 75 to also further functionally guide the shank surface 75 within the concave fingered surface 215, again as best shown in FIGS. 6, 7, 8, 9, and 10.

Again further optionally, on the tensioning device 51, the extension 140 can have a portion that forms an extent 280 that has a straight surface 290 within the first plane 200, wherein the extent 280 is disposed as between the extension second end portion 155 and the concave fingered surface 215, wherein the extent 280 straight surface 290 is parallel 295 to and faces the arm 270 straight surface 275, wherein the extent 280 straight surface 290, the concave fingered surface 215, and the arm 270 straight surface 275 form a continuous surface, as best shown in FIGS. 3 and 5, to even further functionally guide the shank surface 75 within the concave fingered surface 215, again as best shown in FIGS. 6, 7, 8, 9, and 10.

Another option for the tensioning device 51, the concave fingered surface 215 can be formed from a first radius 250 emanating from a point 245 and the platform surface 225 that originates at the concave fingered surface 215 and terminates at a platform periphery 230, wherein the platform periphery 230 is defined by a second radius 260 emanating from the point 245, wherein the second radius 260 has a second radius length 265 that is at least two times a first radius length 255, see FIG. 3, to operationally have a platform surface area 225 that is sufficient to be functional for the flange surface 80 of the screw 55 to have the slidable axial contact 325, again as best shown in FIGS. 6, 7, 8, 9, and 10. Further, alternatively, for the tensioning device 51, the obtuse angle 195 is no more than one-hundred and seventy-five degrees (175°), see FIGS. 3 and 4; to operationally allow the extension 140 to separate 165 from the surface 125 for easier manual grasping 310, see FIG. 10.

Broadly, in referring to FIGS. 1, 2, and 5 the present invention is of the tensioning device 50 for securing the rotationally free screw 55 that retains the article 120 to the surface 125 through the aperture 135 in the surface 125, see FIGS. 8, 9, and 10. The screw 55 including external threads 65 with the screw 55 having the head portion 70, wherein the screw 55 has an outer shank surface 75 and the head 70 has a perpendicularly oriented 85 flange surface 80, with the shank 75 and flange 80 surfaces being about a longwise axis 90, see FIGS. 6, 7, 8, 9, and 10. Further the expanding nut 95 is threadably engaged 110 to the screw threads 65, wherein the nut 95 has the expanded open state 100 and the closed collapsed state 105, see in particular FIGS. 9 and 10.

The tensioning device 50 as shown in FIGS. 1, 2, and 5, includes the pair of extensions 145 each having the first end portion 150 and the opposing second end portion 155 with the longitudinal axis 160 spanning therebetween, also included in the tensioning device 50 is the arcuate element 170 having the pair of arcuate end portions 181 with the arcuate axis 185 spanning therebetween. Wherein each one of the arcuate end portions 181 are affixed 191 to each one of the second end portions 155 forming a pair of affixments 191 such that each longitudinal axis 160 and the arcuate axis 185 are positioned at the obtuse angle 195 to one another in a pair of first planes 200 and the pair of longitudinal axes 160 and the arcuate axis 185 are positioned substantially coincident 205 to one another at each affixment 191 in a second plane 210. The arcuate element 170 includes the concave fingered surface 215 that is parallel 220 to the arcuate axis 185; further the arcuate element 170 including the platform surface 225 that is positioned perpendicular 235 to the concave fingered surface 215.

Wherein operationally, the shank surface 75 slidably pilots 320 on the concave fingered surface 215 and the flange surface 80 has a slidable axial contact 325 on the platform surface 225 such that the screw 55 can freely rotate 60 in the slidable pilot 320 and simultaneously be subject to a selected axial force 330, 335 along the longwise axis 90 via a manual grasping 310 of the pair of extensions 145 to facilitate contact frictional pressure 115 of the nut 95 in the open state 100 as against the hidden portion 130 of the surface 125 to allow the screw 55 to tighten 340 against the nut 95 thereby securing the article 120 to the surface 125, see FIGS. 6, 7, 8, 9, and 10.

Optionally on the tensioning device 50, the concave fingered surface 215 is at least preferably structurally semi-circular 240 in circumferential length within the first plane 200, see FIGS. 1 and 5, to better encompass the shank surface 75 to functionally guide the shank surface 75 within the concave fingered surface 215, see FIGS. 6, 7, 8, 9, and 10. Further alternatively, for the tensioning device 50, wherein each extension 145 can have a portion includes an extent 280 form the pair of extents 285, wherein each extent 280 that has a straight surface 290 within the first plane 200, wherein each extent 280 is disposed as between each extension 140 second end portion 155 and the concave fingered surface 215. Wherein the pair of extent 285 straight surfaces 290 are parallel 295 to and oppositely face 295 one another, wherein the extent 285 straight surface 290, the concave fingered surface 215, and the oppositely facing 295 extent 285 straight surface 290 form a continuous surface, see FIGS. 1 and 5, to even further functionally guide 320 the shank surface 75 within the concave fingered surface 215, as best shown in FIGS. 6, 7, 8, 9, and 10.

Another option for the tensioning device 50, wherein the concave fingered surface 215 is formed from the first radius 250 emanating from the point 245 and the platform surface 225 originates at the concave fingered surface 215 and terminates at the platform periphery 230, wherein the platform periphery 230 is defined by the second radius 260 emanating from the point 245, wherein the second radius 260 has a second radius length 265 that is at least two times the first radius length 255, see FIG. 1, to operationally have a platform surface area 225 that is sufficient to be functional for the flange surface 80 of the screw 55 to have the slidable axial contact 325, again see FIGS. 6, 7, 8, 9, and 10. Further, alternatively, for the tensioning device 50, the obtuse angle 195 is no more than one-hundred and seventy-five degrees (175°), see FIGS. 1 and 2; to operationally allow the pair of extensions 145 to separate 165 from the surface 125 for easier manual grasping 310, see FIG. 10.

METHOD OF USE

Focusing primarily on use FIGS. 6, 7, 8, 9, and 10, a method is disclosed for using the tensioning device 50, 51 for securing the rotationally free 60 screw 55 that retains the article 120 to the surface 125 through the aperture 135 in the surface 125, the screw 55 including external threads 65 with the screw 55 having the head portion 70, wherein the screw 55 has the outer shank surface 75 and the head 70 has a perpendicularly 85 oriented flange surface 80, the shank 75 and flange 80 surfaces being about the longwise axis 90, an expanding nut 95 threadably engaged 110 to the screw threads 65, wherein the nut 95 has the open expanded state 100 and the closed collapsed state 105. The method for using the tensioning device 50, 51 includes the steps of firstly providing the tensioning device 50, 51 as previously described and shown in FIGS. 1, 2, 3, 4, and 5, and secondly a step of inserting 300 the rotationally free 60 screw 55 and nut 95 in the closed state 105 therethrough the article 120 and the aperture 135 leaving the head 70 portion external 305 to the aperture 135, see in particular FIG. 9.

Thirdly a step of grasping 310 the extension 140, 145, as best shown in FIGS. 6, 7, 8, and 10, further a fourth step of positioning 315 the concave fingered surface 215 to be adjacent to the shank surface 75 and the platform surface 225 to be in slidable contact 325 with the flange surface 80, see FIGS. 6, 7, and 8. Next, a fifth step of exerting a manual force 335 upon the extension 140, 145 away from the surface 125 which in effect creates a force 330 along the longwise axis 90 of the screw 55 thereby causing contact frictional pressure 115 of the nut 95 in the open state 100 as against the hidden portion 130 of the surface 125 to allow the screw 55 to tighten 340 against the nut 95 thereby securing the article 120 to the surface 125, see FIG. 8. Further, a sixth step of tightening 340 the screw 55 via rotating 60 the screw 55 about the longwise axis 90 to draw the flange 80, article 120, surface 125, and nut 95 axially together 350 along the longwise axis 90.

Alternatively, for the method for using the tensioning device 50, 51, an optional additional step would further comprise removing 345 the arcuate element 170 to be clear from the screw flange 80 and shank 75 immediately prior to the flange 80, article 120, and surface 125 axially contacting 350 one another along the longwise axis 90 from tightening 340, see FIG. 10. Also, alternatively, for the method for using the tensioning device 50, 51, can further comprise a step of finishing the screw 55 tightening 340 via rotating 60 the screw 55 about the longwise axis 90 to have an axial contact 350 as between the flange 80, article 120, surface 125, and nut 95. Noting that the tensioning device 50, 51 may or may not be left in place under the screw 55 flange 80 after the tightening 340 contact 350.

CONCLUSION

Accordingly, the present invention of a tensioning device and method of use has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A tensioning device for securing a rotationally free screw that retains an article to a surface through an aperture in the surface, the screw including external threads with the screw having a head portion, wherein the screw has an outer shank surface and the head has a perpendicularly oriented flange surface, the shank and flange surfaces being about a longwise axis, an expanding nut threadably engaged to the screw threads, wherein the nut has an expanded open state and a closed collapsed state, said tensioning device comprising:

(a) an extension having a first end portion and an opposing second end portion with a longitudinal axis spanning therebetween; and (b) an arcuate element having a proximal end portion and an opposing distal end portion with an arcuate axis spanning therebetween, wherein said proximal end portion is affixed to said second end portion forming an affixment such that said longitudinal axis and said arcuate axis are positioned at an obtuse angle to one another in a first plane and said longitudinal axis and said arcuate axis are positioned substantially co-incident to one another at said affixment in a second plane, said arcuate element including a concave fingered surface that is parallel to said arcuate axis, further said arcuate element including a platform surface that is positioned perpendicular to said concave fingered surface, wherein operationally the shank surface slidably pilots on said concave fingered surface and the flange surface has a slidable axial contact on said platform surface such that the screw can freely rotate in said slidable pilot and simultaneously be subject to a selected axial force along the longwise axis via a manual grasping of said extension to facilitate contact frictional pressure of the nut in the open state as against a hidden portion of the surface to allow the screw to tighten against the nut thereby securing the article to the surface.

2. A tensioning device for securing a rotationally free screw according to claim 1 wherein said concave fingered surface is at least structurally semi-circular in circumferential length within said first plane to better encompass the shank surface to functionally guide the shank surface within the concave fingered surface.

3. A tensioning device for securing a rotationally free screw according to claim 2 wherein said concave fingered surface continues to an arm that has a straight surface within said first plane to further encompass the shank surface to further functionally guide the shank surface within the concave fingered surface.

4. A tensioning device for securing a rotationally free screw according to claim 3 wherein said extension has a portion that forms an extent that has a straight surface within said first plane, wherein said extent is disposed as between said extension second end portion and said concave fingered surface, wherein said extent straight surface is parallel to and faces said arm straight surface, wherein said extent straight surface, said concave fingered surface, and said arm straight surface form a continuous surface to even further functionally guide the shank surface within the concave fingered surface.

5. A tensioning device for securing a rotationally free screw according to claim 4 wherein said concave fingered surface is formed from a first radius emanating from a point and said platform surface originates at said concave fingered surface and terminates at a platform periphery wherein said platform periphery is defined by a second radius emanating from said point, wherein said second radius has a second radius length that is at least two times a first radius length to operationally have a platform surface area that is sufficient to be functional for the flange surface of the screw to have said slidable axial contact.

6. A tensioning device for securing a rotationally free screw according to claim 5 wherein said obtuse angle is no more than one-hundred and seventy-five degrees(175°) to operationally allow said extension to separate from the surface for easier manual grasping.

7. A tensioning device for securing a rotationally free screw that retains an article to a surface through an aperture in the surface, the screw including external threads with the screw having a head portion, wherein the screw has an outer shank surface and the head has a perpendicularly oriented flange surface, the shank and flange surfaces being about a longwise axis, an expanding nut threadably engaged to the screw threads, wherein the nut has an expanded open state and a closed collapsed state, said tensioning device comprising:

(a) a pair of extensions each having a first end portion and an opposing second end portion with a longitudinal axis spanning therebetween; and (b) an arcuate element having a pair of arcuate end portions with an arcuate axis spanning therebetween, wherein each one of said arcuate end portions is affixed to each one of said second end portions forming a pair of affixments such that each said longitudinal axis and said arcuate axis are positioned at an obtuse angle to one another in a pair of first planes and said pair of longitudinal axes and said arcuate axis are positioned substantially co-incident to one another at each said affixment in a second plane, said arcuate element including a concave fingered surface that is parallel to said arcuate axis, further said arcuate element including a platform surface that is positioned perpendicular to said concave fingered surface, wherein operationally the shank surface slidably pilots on said concave fingered surface and the flange surface has a slidable axial contact on said platform surface such that the screw can freely rotate in said slidable pilot and simultaneously be subject to a selected axial force along the longwise axis via a manual grasping of said pair of extensions to facilitate contact frictional pressure of the nut in the open state as against a hidden portion of the surface to allow the screw to tighten against the nut thereby securing the article to the surface.

8. A tensioning device for securing a rotationally free screw according to claim 7 wherein said concave fingered surface is at least structurally semi-circular in circumferential length within said first plane to better encompass the shank surface to functionally guide the shank surface within the concave fingered surface.

9. A tensioning device for securing a rotationally free screw according to claim 8 wherein each said extension has a portion includes an extent forming a pair of extents, wherein each said extent that has a straight surface within said first plane, wherein each said extent is disposed as between each said extension second end portion and said concave fingered surface, wherein said pair of extent straight surfaces are parallel to and oppositely face one another, wherein said extent straight surface, said concave fingered surface, and said oppositely facing extent straight surface form a continuous surface to even further functionally guide the shank surface within the concave fingered surface.

10. A tensioning device for securing a rotationally free screw according to claim 9 wherein said concave fingered surface is formed from a first radius emanating from a point and said platform surface originates at said concave fingered surface and terminates at a platform periphery wherein said platform periphery is defined by a second radius emanating from said point, wherein said second radius has a second radius length that is at least two times a first radius length to operationally have a platform surface area that is sufficient to be functional for the flange surface of the screw to have said slidable axial contact.

11. A tensioning device for securing a rotationally free screw according to claim 10 wherein said obtuse angle is no more than one-hundred and seventy-five degrees(175°) to operationally allow said pair of extensions to separate from the surface for easier manual grasping.

12. A method for using a tensioning device for securing a rotationally free screw that retains an article to a surface through an aperture in the surface, the screw including external threads with the screw having a head portion, wherein the screw has an outer shank surface and the head has a perpendicularly oriented flange surface, the shank and flange surfaces being about a longwise axis, an expanding nut threadably engaged to the screw threads wherein the nut has an open expanded state and a closed collapsed state, said method for using said tensioning device comprising the steps of:

(a) providing an extension having a first end portion and an opposing second end portion with a longitudinal axis spanning therebetween;

(b) providing an arcuate element having a proximal end portion and an opposing distal end portion with an arcuate axis spanning therebetween, wherein said proximal end portion is affixed to said second end portion forming an affixment such that said longitudinal axis and said arcuate axis are positioned at an obtuse angle to one another in a first plane and said longitudinal axis and said arcuate axis are positioned substantially co-incident to one another at said affixment in a second plane, said arcuate element including a concave fingered surface that is parallel to said arcuate axis, further said arcuate element including a platform surface that is positioned perpendicular to said concave fingered surface, wherein operationally the shank surface slidably pilots on said concave fingered surface and the flange surface has a slidable axial contact on said platform surface such that the screw can freely rotate in said slidable pilot and simultaneously be subject to a selected axial force along the longwise axis via a manual grasping of said extension;

(c) inserting the rotationally free screw and nut in the closed state therethrough the article and the aperture leaving the head portion external to the aperture;

(d) grasping said extension;

(e) positioning said concave fingered surface to be adjacent to the shank surface and said platform surface to be in slidable contact with the flange surface;

(f) exerting a manual force upon said extension away from the surface which in effect creates a force along the longwise axis of the screw thereby causing contact frictional pressure of the nut in the open state as against a hidden portion of the surface to allow the screw to tighten against the nut thereby securing the article to the surface; and (g) tightening the screw via rotating the screw about the longwise axis to draw the flange, the article, the surface, and nut axially together along the longwise axis.

13. A method for using a tensioning device according to claim 12 subsequent to said step (g) further comprising a step of removing said arcuate element to be clear from the screw flange and shank immediately prior to the flange, article, and surface axially contacting one another along the longwise axis.

14. A method for using a tensioning device according to claim 13 further comprising a step of finishing said screw tightening via rotating the screw about the longwise axis to have an axial contact as between the flange, article, surface, and nut.

* * * * *